US005390685A

United States Patent [19]

McCoy

[11] Patent Number: 5,390,685

[45] Date of Patent: Feb. 21, 1995

[54] COLLAPSIBLE SHELTER

[76] Inventor: Jens McCoy, Quellen Str. 2, 8906 Gersthosen, Germany

[21] Appl. No.: 48,333

[22] Filed: Mar. 26, 1993

[51] Int. Cl.[6] ..... A45B 21/00

[52] U.S. Cl. ..... 135/19; 135/20.1; 135/31; 135/33.5; 248/286; 248/910

[58] Field of Search ..... 135/16, 19, 19.5, 20.1, 135/21, 90, 98, 99, 106, 108, 31, 33.5; 248/530, 156, 910, 286

[56] References Cited

U.S. PATENT DOCUMENTS

| | | | |
|---|---|---|---|
| 970,751 | 9/1910 | Pranke | 135/16 X |
| 2,146,517 | 2/1939 | Thompson | 135/98 |
| 2,455,288 | 11/1948 | Alvarez | 135/19.5 |
| 2,559,421 | 7/1951 | Garrett | 135/98 X |
| 2,759,486 | 8/1956 | Pesaturo | 135/16 |
| 2,764,993 | 10/1956 | Wallace et al. | 135/20.1 X |
| 3,182,936 | 5/1965 | Murdock | 248/530 |
| 3,204,650 | 9/1965 | Shinen | 135/16 |
| 3,429,320 | 2/1969 | Edelkind | 135/20.1 |
| 3,765,434 | 10/1973 | Riggs | 135/16 X |
| 3,896,831 | 7/1975 | Feldman et al. | 135/108 X |
| 4,637,415 | 1/1987 | Dalo et al. | 135/98 |
| 4,747,569 | 5/1988 | Hoshino | 248/286 |
| 5,161,561 | 11/1992 | Jamieson | 248/530 X |
| 5,169,111 | 12/1992 | Dunaj | 248/910 X |
| 5,178,356 | 1/1993 | Schouwey | 248/910 X |

FOREIGN PATENT DOCUMENTS

| | | | |
|---|---|---|---|
| 0576469 | 5/1958 | Italy | 135/20.1 |

*Primary Examiner*—Lanna Mai

*Attorney, Agent, or Firm*—Donald P. Gillette

[57] ABSTRACT

A portable, umbrella-type shelter including a sheet that can be easily stretched to a framework that includes rods removably attached to one end of a jointed post that has a pointed lower end and a weight that slides against a flange on the lower part of the post to drive the pointed end into the ground. The sheet has loops to be hooked over projections near the outer ends of the rods.

14 Claims, 2 Drawing Sheets

COLLAPSIBLE SHELTER

BACKGROUND OF THE INVENTION

1. Field of the Invention

This invention relates to the field of portable shelters that can be collapsed, or disassembled, into relatively small parts which can then be packed together to form a small bundle that is easy to carry around. In particular, the invention relates to an umbrella-type shelter having a poncho or a similar sheet and a framework to which the sheet can be easily attached for use as a shelter, and from which the sheet can also be easily detached to allow the components of the framework to be disassembled.

2. The Prior Art

It is well-known to form small shelter tents by fastening two sheets together along abutting edges to form a larger sheet that can be draped over a rope or the like so that those abutting edges lie along, or close to, the rope, while the outer edges of the joined sheets, remote from the abutting edges, are spread apart and staked to the ground.

Such tents are not provided with supporting frameworks and cannot be moved in their erected condition. In addition, because they are staked to the ground, they shield only the area bounded by their outer edges and cannot be moved to shield other areas without being taken down and re-erected over such other areas. They cannot be tilted to provide shade from the shifting sun or shelter from the wind and wind-driven rain, nor can they be elevated to allow persons under them to have more convenient movement.

OBJECTS AND SUMMARY OF THE INVENTION

It is an object of this invention to provide a shelter consisting, basically, of a flexible sheet, typically but not exclusively, a poncho, and a framework that comprises individual parts that can be easily and securely joined together to allow the sheet be stretched over the assembled framework and easily attached thereto.

Another object is to provide a shelter of the foregoing type with jointed support means that can be planted at a convenient location and, by operation of the jointed support means, can shift the sheet to provide shade over a selected area that either includes the place where the support means is planted or is adjacent to it.

Those who are skilled in the technology with which this invention deals will recognize further objects after studying the following description.

In accordance with this invention a shelter is formed of a flexible sheet, a collapsible framework over which the sheet can be stretched and to which it can be attached, and support means to support the framework. The sheet has loops, or rings, spaced apart around its perimeter, and the framework has a central spider to which rods can be attached to extend out to locations where the loops will be when the sheet is stretched over the framework. Engagement means are provided at the outer end of each rod to engage a respective one of the loops to hold the sheet taut over the framework. Means are provided to be attached to the spider to support the framework in a position selected by users to position the sheet so that it will shield a desired area from the sun or wind or precipitation.

The support means can be a jointed shaft, one end of which can be driven into the ground and the joints of which can be manipulated by hand to position the shaded area as desired by raising, lowering, or tilting the framework. Then, the joints can be tightened by hand to set the framework rigidly in the selected position.

The invention will be described in greater detail in connection with the drawings, in which like serial numbers in different figures indicate the same item.

DETAILED DESCRIPTION OF A PREFERRED EMBODIMENT

Figure 1:
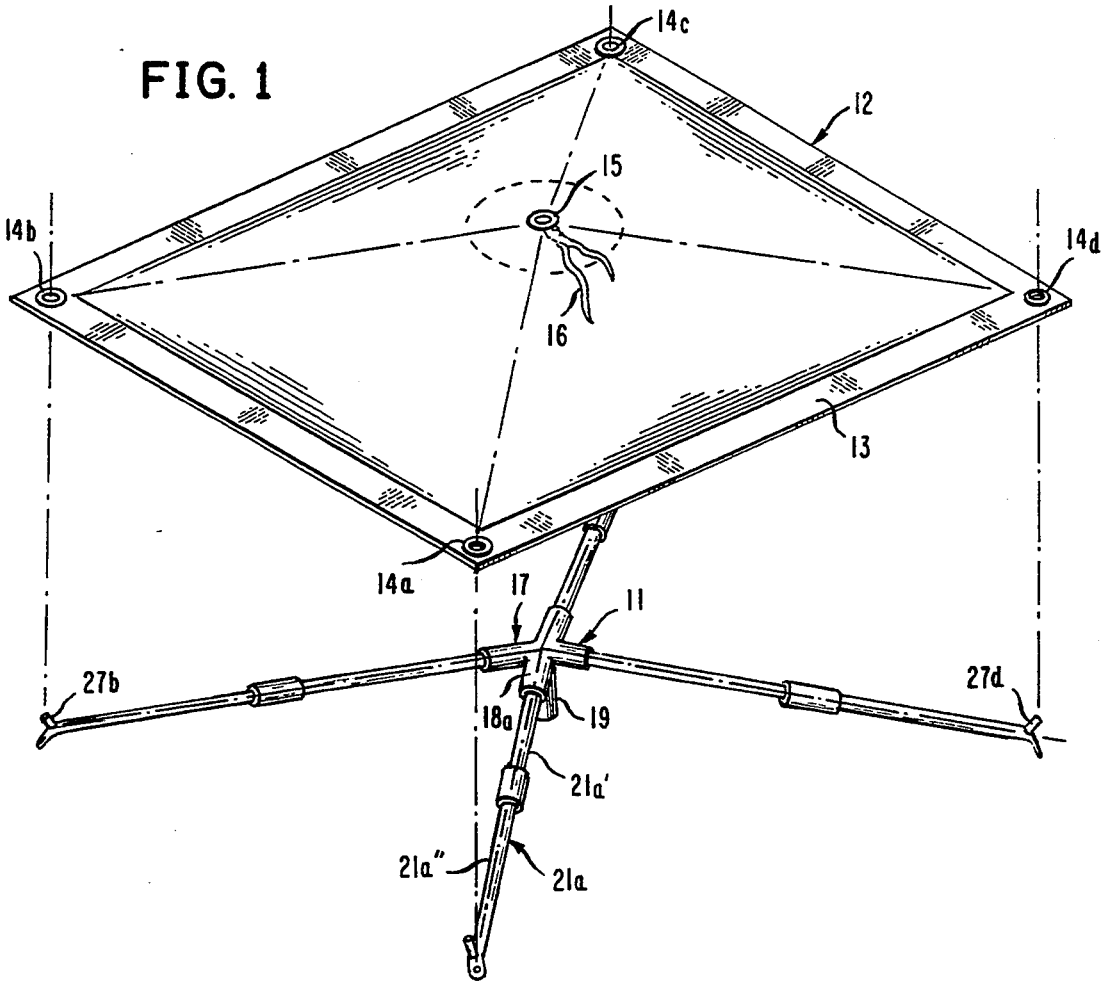
FIG. 1 shows a cover sheet aligned with a framework over which the sheet is to be stretched.
Figure 2:
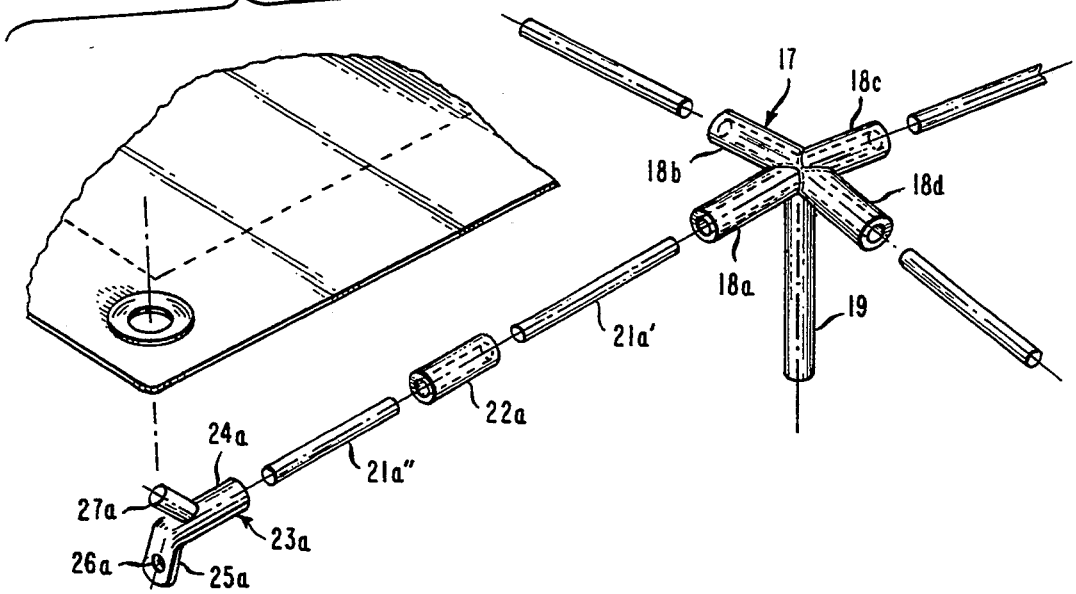
FIG. 2 shows a fragment of the sheet and components of the framework in FIG. 1.

FIGS. 1 and 2 show a framework 11 and a sheet 12 of cloth or other suitable, flexible sheet material that can easily be attached to and detached from the framework. In this embodiment, the cover is a rectangular poncho, which is normally intended to be worn as protection from the weather and includes a hem 13 around the perimeter, reinforcement rings 14*a*–14*d* at the corners, and a central hood 15 with a cord 16 to tie the hood snugly in place around the wearer's face. However, the hood has no function when the poncho is used as a shelter in accordance with this invention, and the string may be used to tie it shut. Alternatively, a plain sheet may be used in place of a standard poncho, and it need not be the same size or even the same shape as a standard poncho, provided it has means that perform the function of the rings 14 at its corners. It should be waterproof or water-repellant and sturdy enough to stand a lot of wear and tear. Ponchos have both of those abilities, and they are of a convenient size, which is why they are particularly useful as the sheet 12 in this invention.

The framework is made so that it can be disassembled into small components for ease of packing and carrying, and it includes a spider 17 that has four tubular receptacles 18*a*–18*d* and a tubular stem 19, all joined together at a central location. The receptacles 18 radiate generally outwardly toward locations determined by the shape of the cover 12, and specifically, toward the places where the rings 14*a*–14*d* will be when the sheet 12 is stretched over the framework. Each receptacle has one end of a rod 21*a*–21*d*, respectively, removably inserted in it, and in order to minimize the space into which the disassembled framework can be packed, each rod may be divided into two sections, as illustrated by the sections 21*a*′ and 21*a*″ of the rod 21*a*, joined end-to-end by a coupling sleeve 22*a* from which the sections can easily be removed.

At the outer end of each of the sections 21*a*″–21*d*″ is an end member 23*a*–23*d*, respectively. Only the end member 23*a* is shown in detail; the others are similar to it. One end 24*a* of the end member 23*a* is tubular and fits over the proximal end of the section 21*a*″ and the other end 25*a*of the end member 23*a* is shown as being provided with an aperture 26*a*through which a cord or a hook (not shown) can be inserted to tie the shelter down, if desired. In this embodiment, the end 25*b* is flattened and bent over to make an angle of a little greater than 90° with respect to the tubular end 24*a*. A barb, or projection, 27*a* extends at an angle to the tubular end 24*a* and away from the end 25*a*. The fact that the projection 27*a* and the end 25*a* extend away from each other forms a notch between them, which allows the ring 14*a* to fit over the projection 27*a* but prevents it from sliding along the section 21*a*'' of the rod.

The overall distance along the framework 11 from each of the projections 27*a*–27*d* to the center of the spider 17 is approximately equal to the distance from the center of the sheet 12 to the respective ring 14*a*–14*d* and is great enough to stretch the sheet taut. In addition, the receptacles 18*a*–18*d* need not be co-planar but may be, as they are shown, directed slightly downwardly from their common junction point, so that each of them makes an angle slightly less than 90° with the tubular stem 19. The fact that the tubular receptacles 18 all extend in a slightly downward direction from their common junction causes the rods 21*a*–21*d* to extend somewhat downwardly as well as outwardly and elevates the center of the cover 12 slightly.

It is important that the rods 21*a*–21*d* and the end members 23*a*–23*d* be non-rotatably joined together so that the projections 27*a*–27*d* will all point in a generally upward direction to hold the cover securely. For example, the end members 23*a*–23*d* can be welded, soldered, glued or otherwise non-rotatably joined to one end of the respective rod section 21*a*''–21*d*''. For the same reason, the sections 21*a*'–21*d*' must be irrotationally joined by the respective sleeves, or connection members, 22*a*–22*d* and to the respective sections 21*a*''–21*d*'' and to the respective tubular receptacles 18*a*–18*d*, although, as stated, it is important that the sections 21*a*'–21*d*' be releasably joined to the respective sections 21*a*''–21*d*'' and to the respective receptacle 18*a*–18*d*.

Figure 3:
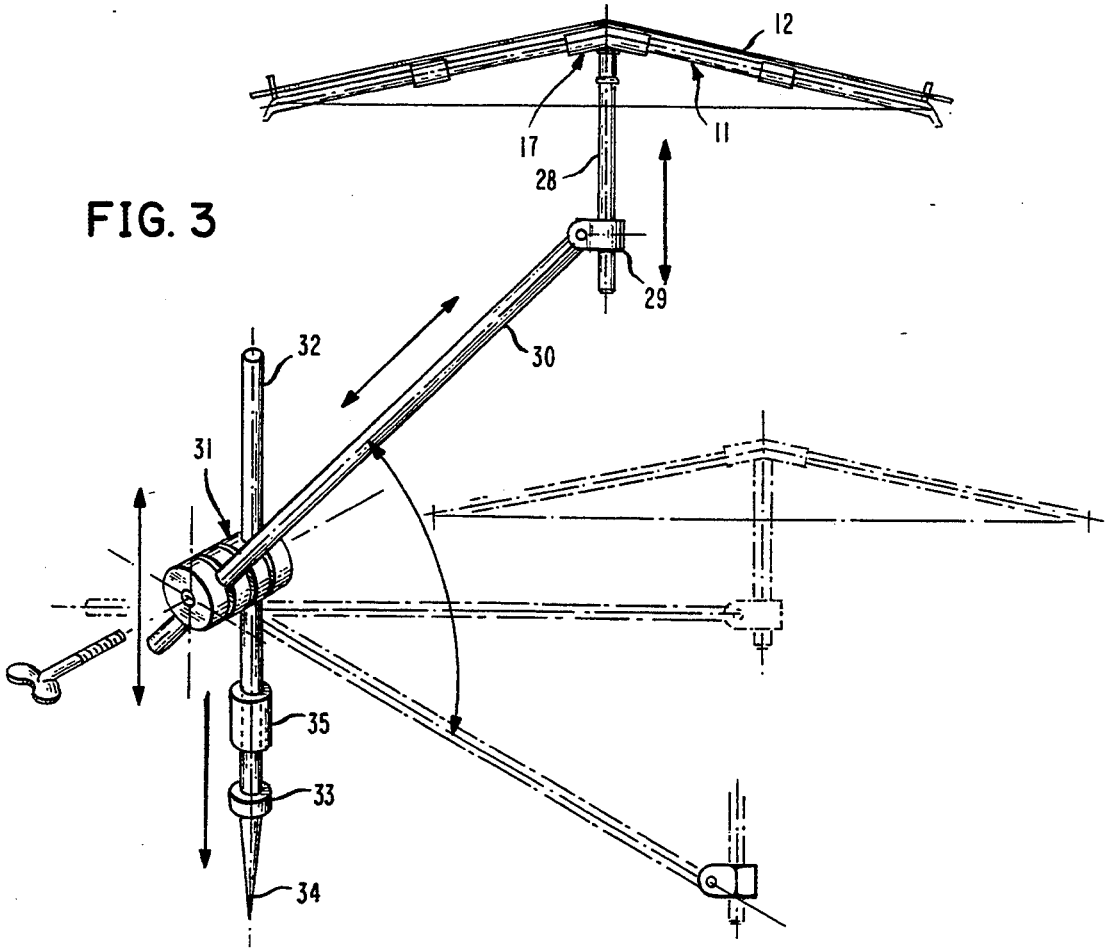
FIG. 3 shows a complete shelter in accordance with this invention.

FIG. 3 shows the cover 12 held tight over the framework 11. It is to be understood that the cover and framework are not necessarily to scale with respect to the support structure below them. The framework 11 is supported on the upper end of a first shaft portion 28 gripped by a first coupling, or joint means, 29 attached to a second shaft portion 30 that is, in turn, gripped by a second coupling, or joint means, 31. The latter coupling is supported on a third shaft portion 32 that has a flange 33 and, below the flange, a lower, pointed end 34 that can be driven into the ground. To assist in doing so, a tubular weight 35 encircles the third shaft portion above the flange and can be raised vertically along the third shaft portion 32 and brought down against the flange by gravitational force, alone, or, normally, with the manual assistance of a person intending to use the shelter.

The couplings 29 and 31 are manually operable, both to release their grip on the respective shaft portions that pass through them so that those portions can be slid with respect to the couplings, and to allow the shaft portions to be angularly pivoted with respect to each other. FIG. 3 shows three angular displacements of the shaft portion 30 with respect to the shaft portions 28 and 32 to shift the vertical position of the sheet 12. By operating only one of the couplings, the uppermost shaft portion 28 can be tilted with respect to either or both of the shaft portions 30 and 32.

Figure 4:
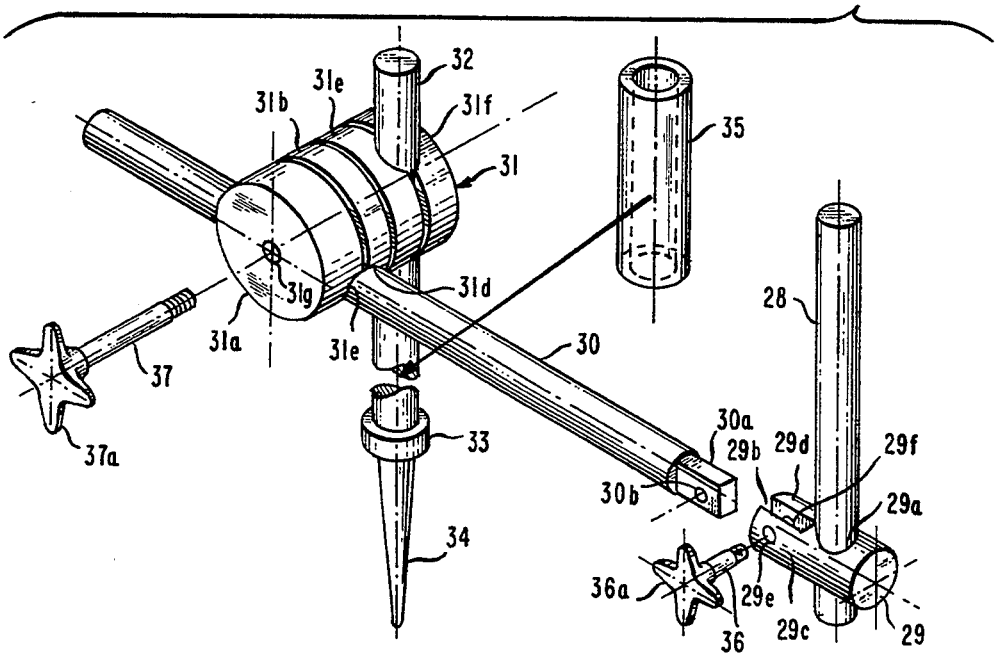
FIG. 4 shows the main support structure of the shelter in FIG. 3.

FIG. 4 shows the support components more clearly. Again, this is only one embodiment of the structure and the components are not necessarily to scale.

The coupling 29 in this embodiment is cylindrically shaped and has a hole 29*a* through which the first shaft portion 28 passes. This hole is at the end of a slot 29*b* that divides one end of the cylinder into two arms 29*c* and 29*d* spaced far enough apart to receive an end 30*a* of the second shaft portion 30. For secure engagement and to allow pivotal movement between the end 30*a* and the arms 29*c* and 29*d*, the end 30*a* has parallel flat surfaces formed on it. The arm 29*c* and the end 30*a* have holes 29*e* and 30*b*, respectively, of large enough diameter to allow a bolt 36 to pass therethrough. The arm 29*d* has a threaded hole 29*f* aligned with the hole 29*e* to receive the threaded end of the bolt. When the bolt passes through the holes 29*e* and 30*b* and is threaded into the hole 29*f*, tightening the bolt 36, which can be done by hand manipulation of its gripping end 36*a*, will draw the arms closer together and lock the shaft portion 28 fixedly with respect to the coupling 29.

At the same time, the arms 29*c* and 29*d* will be brought firmly into engagement with the parallel flat surfaces on the end 30*a* of the second shaft portion 30, setting the vertical position of the upper shaft portion 28 in a fixed position relative to the coupling 29 and holding whatever angle has been set between the shaft portions 28 and 30.

The coupling 31 includes juxtaposed plates 31*a* and 31*b* that have channels 31*c* and 31*d*, respectively, to fit the shaft portion 30, and this coupling also has juxtaposed plates 31*e* and 31*f* that have channels to fit the third shaft portion 32. All four of the plates 31*a*, 31*b*, 31*e* and 31*f* are mounted on a bolt 37 that serves as a common axle to allow the plate-pair 31*a*,31*b* to pivot with respect to the plate pair 31*e*, 31*f*. The bolt 37 has a hand-grip 37*a* and passes through a central hole 31*g* in the plate 31*a* and matching holes in the plates 31*b* and 31*e* to thread into a hole in the plate 31*f*. Tightening the bolt causes the plates 31*a* and 31*b* to grip the shaft portion 30 firmly at any point along its length and the plates 31*e* and 31*f* to grip the shaft portion 32 firmly at any point along its length and the plates 31*b* and 31*e* to engage each other firmly enough to prevent relative rotation between them while holding them in a fixed angular relationship that has been chosen to achieve the desired angle between the shaft portions 30 and 32.

The invention has been described in terms of a specific embodiment, but it will be apparent to those skilled in the technology with which this invention deals that the concept may be embodied in other forms without departing from the true scope of the invention.

What is claimed is:

1. A shelter to shield a certain area of ground, said shelter comprising:

(a) a flexible sheet having a perimeter and a plurality of loops spaced around the perimeter;

(b) a framework over which to spread the sheet, said framework comprising:

(i) a spider having a support member having first and second ends, and a plurality of rod sockets each connected to the support member and extending outwardly in a direction toward a respective one of the loops when the sheet is spread over the framework and attached thereto, (ii) a plurality of rods, each removably inserted in a respective one of the rod sockets and extending outwardly toward the region of the loop associated with the respective rod socket, and (iii) engagement means attached to each of the rods to releasably engage the loop toward which the respective rod extends to hold the sheet taut on the framework;

(c) support means comprising:

(i) shaft means comprising:

(α) a first shaft portion having one end removably attached to the second end of the support member;

(β) a second shaft portion, (γ) first joint means connecting the first shaft portion to the second shaft portion and adjustable to allow the first shaft portion to be set at a selected variety of angular relationships with respect to the second shaft portion and locked in the selected angular relationship, (δ) a third shaft portion, and (ε) second joint means connecting the second shaft portion to the third shaft portion and adjustable to allow the second shaft portion to be set at a selected variety of angular relationships with respect the third shaft portion, one of the joint means comprising an aperture through which the respective shaft portion connected thereto extends, whereby said one of said joint means can be slidably moved to a selected location along the length of the respective shaft portion, and tightening means to secure said one of said joint means at the selected location;

(ii) pointed means on one end of the third shaft portion facing away from the sheet to be driven into the ground, and (iv) a flange on the third shaft means between the second joint means and the pointed means; and (d) a tubular weight encircling and freely movable longitudinally along shaft from a point above the flange down into contact with the flange.

2. The shelter of claim 1 in which the sheet has four corners and each of the loops is adjacent a respective one of the corners.

3. The shelter of claim 1 in which each of the rods comprises two pieces, and the framework comprises a separate releasable connection member joining the two pieces of each rod together.

4. The shelter of claim 1 in which the engagement means on each rod comprises a projection held on the rod and extending therefrom in a direction opposite the direction in which the second end of the support means extends from the first end thereof.

5. The shelter of claim 1 in which the engagement means comprises:

(a) a main portion fitting over one end of a respective rod and held in fixed position thereon; and (b) a projection extending from the main portion in a direction generally opposite the direction in which the second end of the support means extends from the first end thereof.

6. The shelter of claim 1 in which the support member is tubular socket.

7. The shelter of claim 6 in which one end of each of the rod sockets is rigidly attached to the support member near one end of the support member.

8. The shelter of claim 6 in which the shaft comprises multiple parts hinged together.

9. A shelter comprising:

(a) a flexible sheet having a perimeter and a plurality of loops spaced around the perimeter;

(b) a framework comprising:

(i) a spider comprising a support member having two ends, and a plurality of rod sockets connected to the support member and extending outwardly therefrom toward a respective one of the loops, (ii) a plurality of rods, each removably inserted in a respective one of the rod sockets and extending outwardly toward the region of a respective loop, and (iii) engagement means on each of the rods, each of the engagement means comprising:

(α) a tubular end to fit onto the outwardly directed end of a respective one of the rods, and (β) a Y-shaped outer portion having a first branch to releasably engage the respective loop to hold the sheet taut on the framework when the sheet is spread over the framework with a central point in the sheet engaging one end of the support member and each engagement means inserted in a respective loop, and a second branch flattened and provided with an aperture.

10. The shelter of claim 9 in which each of the rods is held irrotationally in its respective rod socket.

11. The shelter of claim 9 in which each of the rod sockets extends out from the support means at the same angle.

12. The shelter of claim 9 in which the support member is a support socket, and the shelter further comprises a shaft that fits into the tubular support socket.

13. The shelter of claim 9 in which each of the engagement means comprises a Y-shaped outer portion comprising first and second branches, the first branch of each of the Y-shaped outer portions comprising a projection to be inserted into a respective one of the loops.

14. The shelter of claim 9 in which the branches of each Y-shaped outer portion have an angle of slightly less than 90° between them.

* * * * *